United States Patent [19]

Cooper

[11] Patent Number: 4,685,265

[45] Date of Patent: Aug. 11, 1987

[54] ROOF RIDGE CAPPING SYSTEM

[75] Inventor: Christopher A. Cooper, Maidstone, England

[73] Assignee: Marley Tile A.G., Switzerland

[21] Appl. No.: 589,103

[22] PCT Filed: Jun. 21, 1983

[86] PCT No.: PCT/GB83/00158

§ 371 Date: Feb. 14, 1984

§ 102(e) Date: Feb. 14, 1984

[87] PCT Pub. No.: WO84/00187

PCT Pub. Date: Jan. 19, 1984

[30] Foreign Application Priority Data

Jun. 25, 1982 [GB] United Kingdom ..... 8218521

[51] Int. Cl.[4] ..... E04D 1/30; E04B 7/06; F24F 7/02

[52] U.S. Cl. ..... 52/277; 52/57; 52/276; 98/42.21

[58] Field of Search ..... 52/277, 57, 43, 276, 52/278; 98/42.2, 42.21

[56] References Cited

U.S. PATENT DOCUMENTS

| | | | |
|---|---|---|---|
| Re. 8,597 | 2/1879 | Hayes | 52/278 |
| 162,261 | 4/1875 | Wightman | 52/278 |
| 430,367 | 6/1890 | Babcock | 52/277 |
| 595,960 | 12/1897 | May | 52/278 |
| 1,454,070 | 5/1923 | Openshaw | 52/277 |
| 1,653,847 | 12/1927 | Greenstreet | 52/277 |
| 2,183,844 | 12/1939 | Murphy | 52/277 |
| 3,185,070 | 5/1965 | Smith | 98/42.21 |
| 3,481,263 | 12/1969 | Belden | 52/57 |
| 4,015,374 | 4/1977 | Epstein et al. | 52/57 |
| 4,322,924 | 4/1982 | Cooper | 52/57 |
| 4,532,739 | 8/1985 | Cooper | 52/465 |

FOREIGN PATENT DOCUMENTS

| | | | |
|---|---|---|---|
| 464397 | 8/1928 | Fed. Rep. of Germany | 52/277 |
| 2017537 | 10/1971 | Fed. Rep. of Germany | 52/57 |
| 2208771 | 9/1973 | Fed. Rep. of Germany | 52/57 |
| 2258811 | 6/1974 | Fed. Rep. of Germany | 52/57 |
| 2356782 | 5/1975 | Fed. Rep. of Germany | 98/42.21 |
| WO82/00314 | 4/1982 | PCT Int'l Appl. . | |
| 515295 | 11/1939 | United Kingdom | 52/277 |
| 1603095 | 11/1981 | United Kingdom . | |

*Primary Examiner*—William F. Pate, III
*Assistant Examiner*—Michael Safavi
*Attorney, Agent, or Firm*—Bacon & Thomas

[57] ABSTRACT

A capping system for a roof ridge comprised capping members, e.g., ridge tiles, connected to a reentrant portion arranged to overly ends of tiles adjacent the ridge. Filler members are disposed between the tiles and reentrant portion. Ridge interior is ventilated by circulation of air passing over the filler member and through the reentrant portion.

9 Claims, 3 Drawing Figures

ROOF RIDGE CAPPING SYSTEM

This invention relates to the capping of roof ridges.

A roof ridge capping member is described in U.K. Pat. No. 1,603,095 which comprises a pair of longitudinally extending flanges interconnected by a capping section. At least one of the flanges is connected to the capping section by a re-entrant portion which defines with the flange a longitudinally extending recess, the re-entrant portion forming the upper wall of the recess. The flange is provided with a longitudinally extending abutment surface which faces into the recess. In use, the member is secured to roof rafters, for example by nails passing through the flanges, and the ends of roof tiles may be located in the recess with their nibs engaging over the abutment surface. Such a member has the advantage that no mortar is needed at the ridge of the roof and furthermore no top course tiling battens are required. Thus, the construction of the ridge is considerably simplified.

A further capping system is described in published International Pat. Specification No. WO82/00314 wherein a pair of elongate members are securable to a roof adjacent to and either side of a ridge thereof, a plurality of capping members being positionable over the ridge of the roof to provide a cap therealong. Locating elements are adapted to pass over the capping members and interlock with the elongate members so as to hold the capping members in position. Thus, conventional capping members such as ridge tiles may be employed and may be located without the use of mortar. As with the capping members of U.K. Pat. No. 1,603,095 discussed above, the elongate members of this system preferably include a recess in which the ends of the roof tiles are disposed. In both cases, the element of the system defining the recess is preferably formed of a somewhat flexible or semi-rigid material such as extruded plastics or sheet steel and the dimensions of the recess relative to the tile thickness are such that the tile may be firmly clamped in place.

Clearly an important requirement for any roof ridge capping system is adequate weathering and it is essential that water is prevented from seeping beneath the capping members or the tiles. Thus, with either of the systems discussed above it is important that there is an adequate seal between the upper wall of the tile retaining recess, which rests against the tile, and the upper surface of the tile. In this connection, problems are encountered where profiled roof tiles are used since the upper wall of the recess which engages the top surface of the tiles does not follow the profile of the tiles and as a result gaps are formed through which water can flow. This problem may be overcome by means of filler units or members which are disposed between the upper surface of the tiles and the upper wall of the tile retaining recess. A lower tile engaging portion of each filler is profiled so as to follow the contours of the tiles while an upper portion thereof presents a substantially flat surface which is engaged by the upper wall of the tile retaining recess.

However, it is also important that the region below the capping members is adequately ventilated to reduce the effect of condensation in the roof space, and it has therefore been proposed to provide ventilation slots or holes in the element defining the recess. However, the use of a filler member substantially blocks effective air flow from outside the roof to beneath the capping members and adequate ventilation is not achieved. It is thus an object of this invention to provide a solution to the problem of ensuring adequate ventilation whilst retaining efficient weathering.

According to the invention there is provided a roof ridge capping system comprising a ridge capping portion connected to a re-entrant portion which is arranged to overly and weather the end of a tile adjacent the ridge, the tile having a profiled upper surface and there being a filler member disposed between the re-entrant portion and the upper surface of the tile, the filler member having its lower region shaped so as to match the profile of the tile surface, wherein the upper region of the filler member is provided with a recessed portion adjacent the outer edge of the re-entrant portion so as to define a flow passage thereunder, and means are provided for placing the flow passage in flow communication with the interior of the roof ridge under the ridge capping portion.

Such an arrangement provides adequate ventilation whilst retaining the weathering provided by the re-entrant portion and filler member. The recessed portion need only extend over a short longitudinal distance. There is no immediate access to the upper surface of the tile covered by the filler/re-entrant portion. Thus the arrangement has advantages over, e.g. the use of simple apertures in the filler member.

The capping portion may be provided by conventional ridge tiles in which case locating elements such as those described in the aforesaid International Patent Specification No. WO82/00314 may be used to secure them at either side to a respective elongate member which is securable to the roof either side of the ridge thereof at least one member having the re-entrant portion. Alternatively, the capping portion may be integral with a re-entrant portion as described in U.K. Pat. No. 1,603,095. In either case, a re-entrant portion may be provided on both sides of the ridge or on only one side in the case of a monopitch roof.

Preferably, and as described in the U.K. Pat. No. 1,603,095 and the International Patent Application referred to above, each re-entrant portion is associated with locating means, such as an upwardly extending abutment, provided opposite the re-entrant portion, for use in locating the nib of a tile. The re-entrant portion may thus be integrally formed with a flange carrying the locating means, there being a tile receiving channel defined between them.

The form of the filler member will clearly vary depending on the nature of the roof tiles. As described in U.K. Pat. No. 1,603,095 it may for example be in the form of an elongate member of substantially U-shaped section, having two flanges interconnected by a generally flat portion. One flange, which is profiled to match the contours of the tiles, rests on the surface of the tiles while the other is located behind the back of the tiles. With such a filler member, the generally flat portion, which is engaged by the re-entrant portion could be provided with at least one said recessed portion. Alternatively, the filler member may be generally flat and is provided at its front end with depressions adapted to lie within the longitudinal channels of the profiled tiles. In this arrangement, the ventilation recess or recesses of the filler member are preferably formed adjacent the depressions.

Where a tile receiving channel is provided flow communication with the interior of the ridge may be provided by one or more apertures in the walls of the tile receiving channel. Such apertures are preferably formed in the upper wall of each channel so as to be closely adjacent the recesses in the filler members, although other arrangements may be possible, dependent on available flow paths.

A preferred embodiment of the invention will now be described by way of example with reference to the accompanying drawings, in which.

Figure 1:
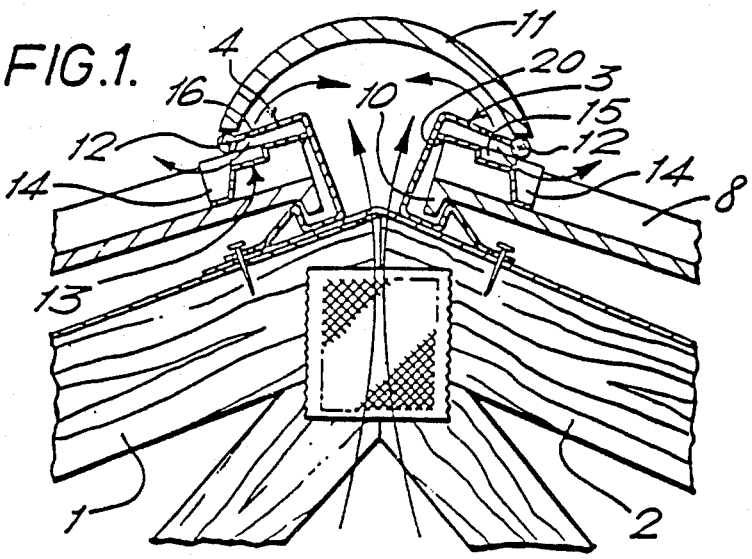
FIG. 1 is a sectional view of a roof ridge incorporating a capping system in accordance with the invention.

Referring then to the drawings, the roof illustrated includes wooden rafters 1, 2 meeting at the ridge and joined together by conventional means. Either side of the ridge is secured an elongate member 3, 4 of the sort described in International Patent Specification No. WO82/00314 which each include a channel 5, defined between upper and lower flanges 6, 7 for receiving the ends 8 of conventional roof tiles adjacent the ridge. The lower flange 7 of each member 3 is formed with an abutment surface 9 facing into the channel adapted for engagement with the nibs 10 on the undersides of the conventional tiles 8. The capping members are in the form of ridge tiles 11 which are secured to the elongate members by means of straps (not shown) engaging around enlarged portions 12 at the end of the upper flanges 6, as described in detail in International Specification No. WO82/00314.

Figure 2:
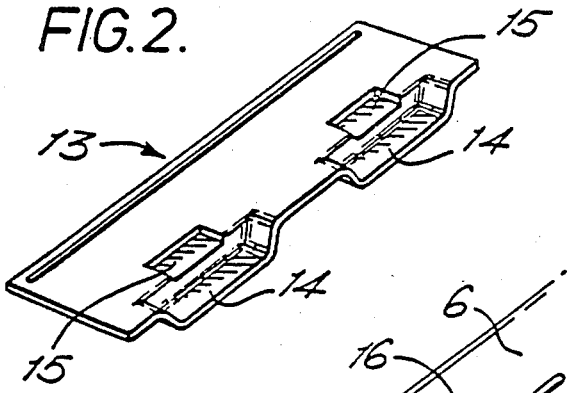
FIG. 2 is a perspective view of the underside of a filler member used in the capping system shown in FIG. 1.
Figure 3:
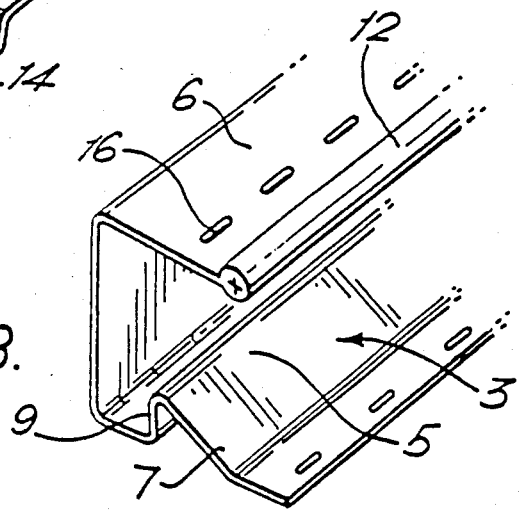
FIG. 3 is a perspective view of part of an elongate member of the system.

Disposed between the upper surfaces of the tiles and the upper flanges 6 are filler members 13, shown most clearly in FIG. 2. The filler members 13 are each provided at their front ends with two spaced depressions 14 adapted to lie within the longitudinal channels of the contoured upper surfaces of the roof tiles 8. As shown in FIG. 1, the filler members 13 are securely held between the tiles and the enlarged portions 12 of the upper flange 6 of the elongate members 3 owing to the resiliency of the members 3. A small ridge 20 is provided at the end of each filler member adapted to engage over the end of the respective tile so as to prevent the filler member sliding down the inclined roof.

It will be seen that the ridge is securely weathered and water is prevented from seeping beneath the capping members.

To enable adequate ventilation of the ridge, recesses 15 are formed in the filler members 13 adjacent the depressions thereof. The recesses 15 define small gaps between the upper surface of the filler members 13 and the adjacent upper flange 6 of the elongate members which communicate with a plurality of apertures 16 formed in the upper flange. Thus, air may circulate from outside the roof to beneath the capping members as shown by the arrows in FIG. 1. Thus, the recesses enable the required ventilation of the ridge while the weathering properties of the system remain unimpaired.

I claim:

1. A roof ridge capping system comprising:

at least one capping member positioned over a roof ridge to provide a cap therealong;

a reentrant portion connected to the capping member on at least one side thereof and extending inwardly thereunder, said reentrant portion overlying upper ends of roof tiles located adjacent the ridge, said tiles having profiled upper surfaces;

a filler member interposed between the upper surfaces of the tiles and the reentrant portion, the filler member comprising a flat portion defining an upper surface region which engages the reentrant portion, said flat portion being provided at one end thereof with a downwardly extending depression which lies within a longitudinal channel of the tile profile;

wherein said upper surface region of said filler member is provided with at least one recess located adjacent said depression which defines with the reentrant portion a ventilating flow passage, means being provided for placing said flow passage in flow communication with an interior of the roof ridge beneath the capping member.

2. A roof ridge capping system as claimed in claim 1 wherein said means for placing the flow passage in flow communication with the roof ridge interior comprises apertures provided in said reentrant portion.

3. A roof ridge capping system as claimed in claim 2 wherein the filler member further comprises a downwardly projecting part adapted for engagement with the end of the tile.

4. A roof ridge capping system as claimed in claim 1 wherein the filler member further comprises a downwardly projecting part adapted for engagement with the end of the tile.

5. A roof ridge capping system comprising:

at least one capping member positioned over a roof ridge to provide a cap therealong;

a reentrant portion connected to the capping member on at least one side thereof and extending inwardly thereunder, said reentrant portion overlying upper ends of roof tiles located adjacent the ridge, said tiles having profiled upper surfaces;

a filler member interposed between the upper surfaces of the tiles and the reentrant portion, said filler member being generally U-shaped in cross-section and comprising two flanges interconnected by a generally flat portion, the flat portion defining an upper surface region which engages the reentrant portion, a first flange resting on the surface of the tile and being profiled to match the tile profile, and a second flange being located behind the end of the tile;

wherein said upper surface region of said filler member is provided with at least one recess which defines with the reentrant portion a ventilating flow passage, means being provided for placing said flow passage in flow communication with an interior of the roof ridge beneath the capping member.

6. A roof ridge capping system as claimed in claim 5 wherein said means for placing the flow passage in flow communication with the roof ridge interior comprises apertures provided in said reentrant portion.

7. A roof ridge capping system comprising:

at least one capping member positioned over a roof ridge to provide a cap therealong;

a reentrant portion connected to the capping member on at least one side thereof and extending inwardly thereunder, said reentrant portion being connected to a flange so that said portion and flange define a tile receiving channel therebetween, said reentrant portion overlying upper ends of roof tiles located adjacent the ridge and received by said channel said tiles having profiled upper surfaces;

a filler member interposed between the upper surfaces of the tiles and the reentrant portion, the filler member having a lower region shaped so as to match the profile of the tile upper surfaces and having an upper surface region which engages said reentrant portion;

wherein said upper surface region of said filler member is provided with at least one recess which defines with the reentrant portion a ventilating flow passage, at least one aperture being provided in a wall of said channel for placing such flow passage in flow communication with an interior of the roof ridge beneath the capping member.

8. A roof ridge capping system as claimed in claim 7 wherein the aperture or apertures are formed in said reentrant portion.

9. In a roof ridge capping system having a capping member connected to at least one of a pair of longitudinally extending flanges by means of a reentrant portion which defines with the respectivce flange a longitudinally extending channel for receiving upper edges of roof tiles located adjacent the roof ridge and a filler member interposed between the upper surface of each roof tile and the reentrant portion, the filler member having an upper region in weathering engagement with an outer edge of the reentrant portion, the improvement therein comprising:

a recess provided in the upper region of the filler member to provide a ventilating flow passage under the outer edge of said reentrant portion and apertures provided in said reentrant portion for placing said flow passage in flow communication with an interior of the capping system defined beneath said capping member.

* * * * *